United States Patent [19]

Jaeger

[11] Patent Number: 4,522,422

[45] Date of Patent: Jun. 11, 1985

[54] SKI BINDING

[75] Inventor: Knut Jaeger, Kirchheim, Fed. Rep. of Germany

[73] Assignee: ESS GmbH Skibindungen, Immenstadt, Fed. Rep. of Germany

[21] Appl. No.: 441,373

[22] Filed: Nov. 12, 1982

[30] Foreign Application Priority Data

Mar. 13, 1981 [DE] Fed. Rep. of Germany ..... 3109754

[51] Int. Cl.[3] ..... A63C 9/08

[52] U.S. Cl. ..... 280/617; 280/607; 280/633

[58] Field of Search ..... 280/617, 618, 633, 607, 280/611

[56] References Cited

U.S. PATENT DOCUMENTS

| | | | |
|---|---|---|---|
| 2,614,858 | 10/1952 | Pierce, Jr. | 280/617 |
| 3,198,537 | 8/1965 | Silberman | 280/617 |
| 3,702,194 | 11/1972 | Iizuka et al. | 280/633 |
| 3,733,085 | 5/1973 | Iizuka et al. | 280/633 |
| 3,790,186 | 2/1974 | Kanno | 280/617 |
| 3,937,481 | 2/1976 | Koleda | 280/617 |
| 4,141,570 | 2/1979 | Sudmeier | 280/633 X |

FOREIGN PATENT DOCUMENTS

| | | | |
|---|---|---|---|
| 1195649 | 6/1965 | Fed. Rep. of Germany . | |
| 2246668 | 4/1974 | Fed. Rep. of Germany | 280/617 |
| 7639148 | 12/1976 | Fed. Rep. of Germany . | |
| 2554385 | 6/1977 | Fed. Rep. of Germany . | |
| 2554384 | 6/1977 | Fed. Rep. of Germany . | |
| 2635409 | 2/1978 | Fed. Rep. of Germany . | |
| 7805344 | 6/1978 | Fed. Rep. of Germany . | |
| 1464104 | 11/1966 | France | 280/633 |
| 340170 | 9/1959 | Switzerland . | |

*Primary Examiner*—Joseph F. Peters, Jr.
*Assistant Examiner*—Michael Mar
*Attorney, Agent, or Firm*—Ratner & Prestia

[57] ABSTRACT

The ski binding encompasses a toe unit (1) which holds the ski boot at its toe and releases if necessary at an adjustable release moment, as well as a heel binding (2), which holds the ski boot heel and releases if necessary at an adjustable release moment. Both the toe unit (1) as well as the heel binding (2) are mounted along solid guide tracks (5,6) attached lengthwise to the ski so that they can be locked into position and can be slid lengthwise.

The toe unit (1) is joined to the heel binding (2) through a connector element (3). In the toe unit (1) or the heel binding (2) a device is provided for through which the toe unit (1) and the heel binding (2) are simultaneously movable lengthwise along the ski. The heel binding (2) which is connected to the toe unit (1) through the connector element (3) is situated in its solid guide track to be not locked into position and to be slideable lengthwise.

5 Claims, 5 Drawing Figures

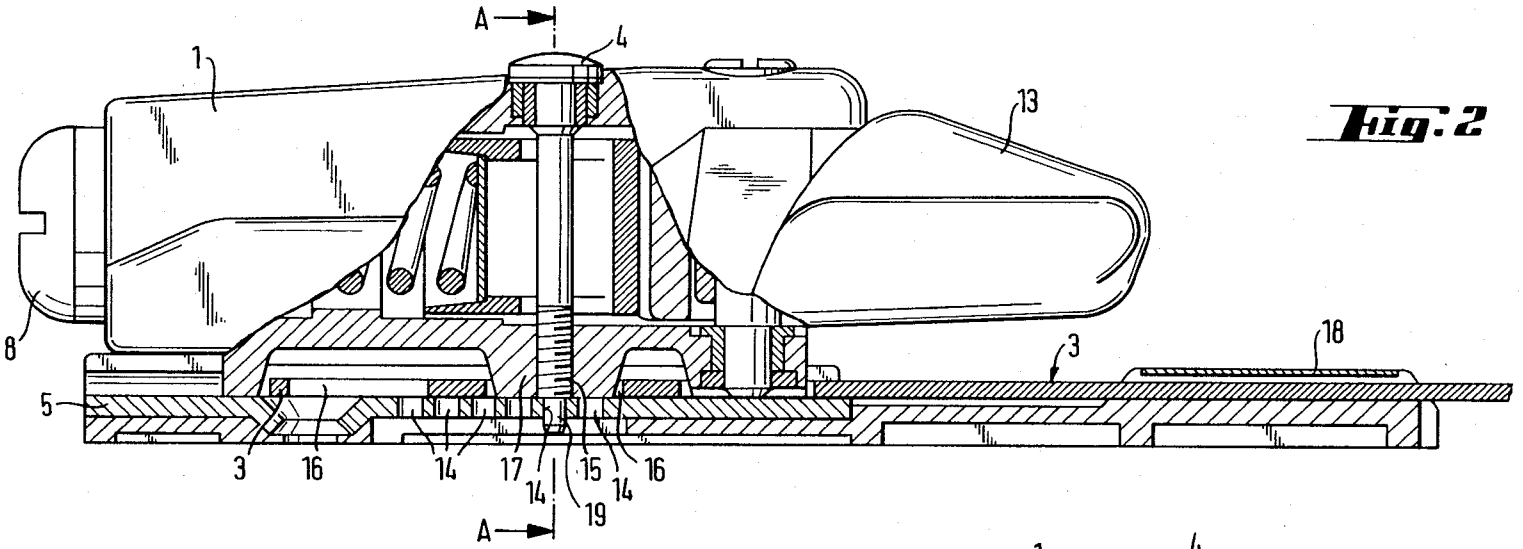
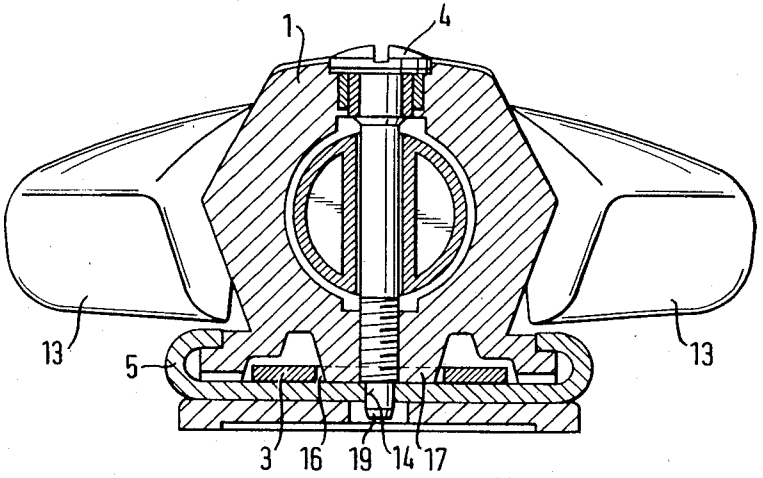
Fig. 3
(A–A)

(B)

SKI BINDING

The present invention relates to a ski binding with a toe unit which holds a ski boot at its toe and which releases if necessary at an adjustable release moment, and a heel binding which holds the ski boot heel and which also releases if necessary at an adjustable release moment. Both the toe unit and the heel binding are mounted along solid guide tracks attached lengthwise to the ski so that they can be locked into position and can be slid lengthwise.

This well-known ski binding, by which the toe unit and the heel binding can be moved individually lengthwise along the ski, has the disadvantage that a desired change of position of the ski boot lengthwise relative to the ski requires several manipulations of the ski binding. In particular, a fine adjustment of the heel binding is required, upon the exact lengthwise adjustment of which the safety function of the complete ski binding can depend.

The purpose of the invention presented here is to avoid this disadvantage of multiple adjustments, and thereby to make possible a movement of the complete ski binding lengthwise along the ski, without any of the safety-relevant adjustments having to be touched and/or checked.

For this purpose, this invention provides for alteration of the ski binding described at the outset so that the toe unit is connected to the heel binding through a connector element, and so that in the heel binding or the toe unit a device is provided through which the toe unit and the heel binding are simultaneously movable lengthwise along the ski.

In construction of the invention for this purpose, it is advantageous that the toe unit can be locked into position at set intervals or with infinite variation in its guide track and relative to it lengthwise along the skis, and that the heel binding, which is joined to the toe unit by the connector element, is situated in its solid guide track to be slidable lengthwise without locking into position. The lengthwise movement of the complete binding through only a single manipulation thereby becomes possible.

In construction of the ski binding in accordance with this invention, the toe unit is movable either in set intervals or with infinite variation relative to the connector element and the heel binding is movable either in set intervals or with infinite variation relative to the connector element lengthwise along the ski.

Further details and characteristics of the invention may be seen in the following description together with the accompanying drawings. These drawings represent examples of the following:

FIG. 2 is a partial-cut side view of the toe unit of the ski binding according to the invention FIG. 3 is a cut-away view along Line A—A in FIG. 2

Figure 1:
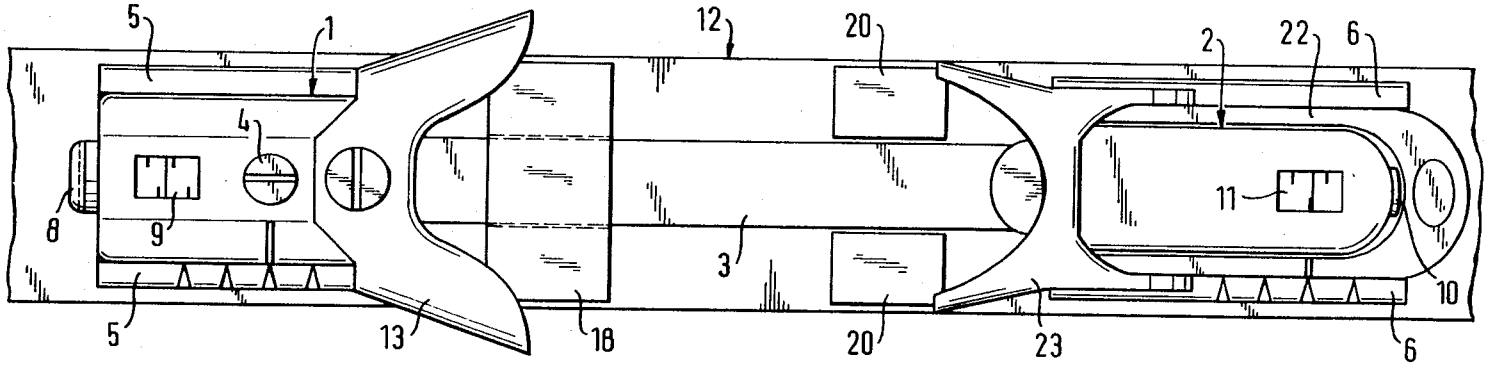
FIG. 1 is a schematic front view of a ski binding according to the invention

A ski binding in accordance with the invention includes: a toe unit (1) which holds a ski boot (not shown) at its toe via a sole holder (13) and which releases when necessary at a release moment set by means of a setting screw (8) and read through a window in the binding; and a heel binding (2) which holds the heel of the ski boot through a heel holder (23) and which releases when necessary at a release moment set through a screw (10) and read through a window (11) in the binding. Both the toe unit (1) and the heel binding (2) are mounted along guide tracks screwed onto the ski so that they can be locked into position and can be moved lengthwise along the ski.

The toe unit (1) according to the invention is joined to the heel binding (2) through a connector element (3). A device is provided in the toe unit (1), for example, in the form of a locking screw (4), so that when the locking screw (4) is loosened, the toe unit (1) together with the heel binding (2) can simultaneously be moved lengthwise along the ski through the use of the connector element (3).

The toe unit (1) in that connection may be locked into position at set intervals (14) along its solid guide track (5). For this purpose the locking screw (4) is inserted into the body of the toe unit by means of a screw mechanism (15). When the locking screw (4) is released, the locking end (19) of the screw nearest the ski comes out of the set interval position (14), and the toe unit may be slid lengthwise along its guide track (5). By such a lengthwise slide of the toe unit (1), the heel binding (2) will simultaneously be moved via the connector element (3) lengthwise along the ski along its guide track (6), because the heel binding is set to be not locked into position along its guide track (6).

In a particularly advantageous embodiment of the invention, the toe unit (1) is constructed to be adjustable at set intervals (16) relative to the connector element (3). In the embodiment shown in FIG. 2, two such setting intervals are provided for, although the number of such settings is in and of itself completely arbitrary.

To move the toe unit (1) from the interval setting (16) closest to the boot to the farthest setting, the locking screw (4) is released, and the toe unit (1) together with the connector element (3) is slid for example, to the left as shown in FIG. 2, out of the guide track (5); the contact (17) is moved from the nearest to the farthest setting 16 from the boot; and the toe unit (1) together with the connector element (3) is then pushed back into the guide track (5), in order to lock the toe unit (1) back into the desired position (14) through use of the locking screw (4).

Advantageously, the connector element (3) between the toe unit (1) and the heel binding (2) would for example, be moved through a plate (18) connected to the guide track (5) that would freely move through the connector element at an appropriate point. At an appropriate spot in the area of the heel binding (2), a heel protector (20) is provided on each side of the connector element on the ski (12) for guidance and for protection of the connector element (3). These heel protectors (20) could also advantageously be constructed as heel protectors connected to the guide track (6) of the heel binding.

Figure 4:
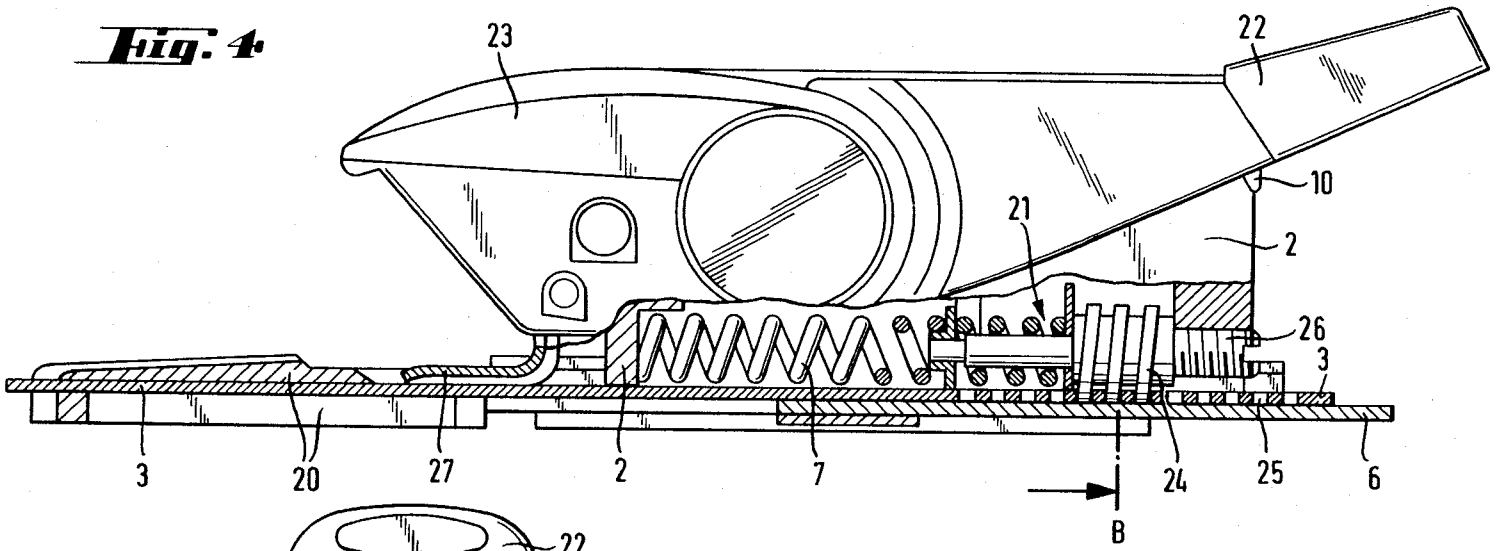
FIG. 4 is a partial-cut side view of a heel binding of a ski binding according to the invention
Figure 5:
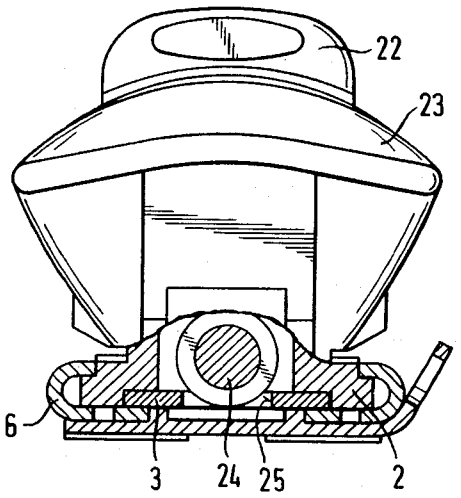
FIG. 5 is a partial-cut view of the Level B in FIG. 4

According to the particularly advantageous embodiment of the invention shown in FIG. 4, the heel binding (2) with the connector element (3) are together set without being locked into position to be slideable lengthwise along the ski along the guide track (6) attached to the ski (12). The connection between the heel binding (2) and the connector element (3) shows a locking device (21) through which the heel binding (2) is lengthwise adjustable, either at set intervals or with infinite variation relative to the connector element (3). The heel binding (2) also has a lever (22) which may be used to cause the heel holder (23) to release the boot sole and to open the heel binding.

The locking mechanism (21) between the heel binding (2) and the connector element (3) advantageously includes a threaded gear (24) in the heel binding, whose threads mesh in a corresponding locking notch (25) in the connected element (3), so that by turning the gear (24) through the end of the screw (26), the heel binding can be infinitely adjusted relative to the connector element (3) lengthwise along the ski. For this purpose at least one spring element (7) is suspended between the threaded gear (24) and the housing of the heel binding (2), which presses the heel binding (2) with its heel holder (23) against the ski boot holder in the direction of the toe unit with substantially constant pressure, particularly upon flexion of the ski.

Advantageously the connected element (3) would be made of a bar of steel or similar material which would be rigid in its length along the ski, combining toe unit and heel binding into an integral unit, while remaining flexible in the plane of the ski in order to not interfere with ski flexion. Through the construction of the binding according to the invention, essentially no tensions could arise which would stiffen the ski between the heel binding and the toe unit.

The operation of the ski binding according to the invention is as follows: with the heel holder (23) open, a ski boot will be positioned with the toe of the boot in the sole holder (13) of the toe binding (1). By turning the screw end (26) of the threaded gear (24), the heel binding (2) will be moved far enough lengthwise along the ski relative to the connector element (3) and in the guide track (6) that the heel of the ski boot closes the heel binding (2) by pressing down on the shackle (27) fastened to the heel holder (23). Fine adjustments lengthwise along the ski can be undertaken through the screw end (26) of the threaded gear (24), whereby such adjustments will be shown on an indicating device which is already well-known. Through this fitting, the ski boot now assumes a certain position along the length of the ski (12). If this position is to be changed towards either the tip or the end of the ski, the locking screw (4) is released, so that the locking end (19) of the screw comes out of the locking notch (14), and the toe unit is then slid into the desired direction until the locking end (19) of the screw is above the desired locking position (14), and can be locked in to position by screwing in the screw. The entire ski binding is thereby moved without individual adjustments, e.g., the horizontal pressure, having to be made. Should the given range of adjustment of the ski bonding available through the locking mechanism (21) in the heel binding not be sufficient to accept various sole lengths, this range of adjustment can be changed or adapted by changing the position of the toe unit (1) relative to the connector element (3) through the various setting intervals (16) and the contact (17).

I claim:

1. A ski binding comprising a toe unit, a first guide track adapted to be fixedly attached to a ski and which carries the toe unit for slidable movement lengthwise of the ski, locking means for selectively fixing the position of the toe unit relative to the first guide track, a heel binding, a second guide track adapted to be fixedly attached to the ski and which carried the heel binding for slidable movement lengthwise of the ski, a connector element which is rigid in the lengthwise direction of the ski while being flexible in the plane of the ski and fixedly attached at its forward end to the toe unit, while the heel binding is slideable along the rear end of the connector element, adjustment means for selectively fixing the position of the heel binding relative to the rear end of the connector element and having a spring element which is located in the path through which the heel binding moves relative to the connector element and which presses the heel binding with substantially constant force against a ski boot inserted into the binding, a stationary plate near the toe unit which forms a passageway for free movement of the connector element therethrough, and heel spacer elements on both sides of the connector element near the heel binding for the protection of the connector element.

2. The ski binding according to claim 1 characterized in that the toe unit is adapted to be locked into position in its guide track relative to said track lengthwise along the ski either in set intervals or with infinite variation and in that the heel binding which is connected to the toe unit through the connector element is supported on its guide track so as not to be lockable into position and is slideable lengthwise.

3. A ski binding according to claim 1, characterized in that the toe unit is movable relative to the connector element either in set intervals or with infinite variation.

4. A ski binding according to claim 1, characterized in that the heel binding is adjustable either in set intervals or with infinite variation relative to the connector element lengthwise along the ski.

5. A ski binding according to claim 1, characterized in that the connector element is a bar.

* * * * *